United States Patent [19]

Abdi

[11] Patent Number: 5,075,935

[45] Date of Patent: Dec. 31, 1991

[54] GARMENT HANGER AND CLIP

[76] Inventor: Abraham M. Abdi, 2940 Echo Hill Way, Orange, Calif. 92667

[21] Appl. No.: 536,749

[22] Filed: Jun. 12, 1990

[51] Int. Cl.[5] ..... A44B 21/00

[52] U.S. Cl. ..... 24/511; 24/500; 24/507

[58] Field of Search ..... 24/511, 520, 521 499, 24/500, 507, 508; 223/93, 96

[56] References Cited

U.S. PATENT DOCUMENTS

| | | | |
|---|---|---|---|
| Re. 32,269 | 10/1986 | Bisk et al. | 24/511 X |
| 2,461,333 | 2/1949 | Maccaferri | 24/511 X |
| 2,471,606 | 5/1949 | Burns | 24/511 X |
| 4,878,276 | 11/1989 | Morrish et al. | 24/511 |

FOREIGN PATENT DOCUMENTS

| | | | |
|---|---|---|---|
| 143506 | 9/1950 | Australia | 24/511 |
| 1159796 | 7/1958 | France | 24/511 |
| 352309 | 4/1961 | Switzerland | 24/511 |

*Primary Examiner*—Laurie K. Cranmer
*Attorney, Agent, or Firm*—G. Donald Weber, Jr.

[57] ABSTRACT

A molded plastic hanger and a clip. The clip may be used with the hanger or separately. The hanger includes a body portion and a hook portion. The body portion includes a pair of parallel arms joined together at the ends thereof and an intermediate crossbar. The swivel hook includes a stem which is connected to the body portion at the crossbar. The stem includes an annular locking recess in its periphery which is adapted to be received within a mating socket of the crossbar to thereby connect the hook portion and the body portion to each other while enabling them to be swiveled readily with respect to each other. The clip can be secured to an arm of the hanger, to any other rod-like element, or to a clothesline, for example. The clip is formed of a two-part construction. The clip comprises a pair of plastic, complementary jaws joined together by a bridge-like member. The bridge-like member is joined, at each end, to the middle portion of each of the complementary jaws by means of a living hinge. A resilient, inverted U-shaped member fits over the bridge-like member and presses against the outer surfaces of the complementary jaws and forces them into engagement. The resilient member is formed of plastic, but has a higher tensile strength and resiliency than the plastic of the jaws.

15 Claims, 1 Drawing Sheet

108
101
125
135
104
119
100
115
117
116
113
114
102
105
103

251
252
253
254
255
250
202
200
220
291
292
246
245
207
201
208
205
206
204
203
211
212
282
209
213
210
280

202
220
291
292
246
251
245
208
252
253
105
204
203
254
255
209
210

108
101
104
100
4.
4.
113
211
208
104
209
116
102
200
105
103

GARMENT HANGER AND CLIP

BACKGROUND

1. Invention

This invention relates, generally, to garment hangers and, more particularly, to molded plastic hangers and clips for use therewith.

2. Prior Art

Commercially available hangers are made of wood, metal, and plastic. Frequently, plastic hangers can be made relatively inexpensively compared to wooden hangers, are substantially more durable than wire hangers.

Conventional, commercially available, plastic hangers commonly comprise a plastic body portion and a metal hook. The hook may be secured to the body to enable the body to swivel with respect to the hook. Examples of hanger structures including a plastic body and a metal suspending hook are described in U.S. Pat. Nos. 3,406,883 (Crane); 3,282,481 (Maxwell); and 3,407,979 (Patch).

All-plastic garment hangers are also commercially available and many have been disclosed in the patent literature. Examples of hangers formed entirely of a plastic material are described in U.S. Pat. Nos. 3,067,917 (Reller, et al); 3,116,860 (Urich); 3,209,966 (Wach); 3,463,369 (Moskowitz); 3,570,729 (Zuckerman); 3,897,893 (Lemmenes); and 3,973,705 (Erthein).

All-plastic hangers having swivel hooks are disclosed in U.S. Pat. Nos. 3,963,154 (Schwartz, et al); 4,040,546 (Liebscher) and 4,074,838 (Blasnik, et al).

Conventional garment hangers also frequently include one or more pinch-type clips arranged to be located at various positions along a crossbar to hold trousers or skirts on the hanger. Examples of such hangers are found in U.S. Pat. Nos. 2,378,578 (Oskow); 2,496,531 (Gray); 2,546,717 (Beetlestone, et al) 2,617,568 (Pechtel) and 3,950,829 (Cohen).

While the plastic hangers noted above do achieve Various design goals, such hangers nevertheless suffer from one or more drawbacks, such as complexity of construction, difficulty of assembly, limited utility, limited durability and ruggedness, and the like.

PRIOR ART STATEMENT

The following references have been discovered in a patentability search and are listed here for convenience.

| U.S. PATENTS | |
|---|---|
| 2,496,109; Terry | 3,239,902; Cohen |
| 2,583,784; Maccaferri | 3,456,262; Coon |
| 2,723,786; Martin | 4,009,807; Coon |
| 3,227,334; Samuelsson | 4,335,838; Bisk et al |

| FOREIGN PATENTS | |
|---|---|
| 1159796; France | 624783 United Kingdom |
| 1210426; France | 697866 United Kingdom |
| 7306492; Netherlands | 714990 United Kingdom |
| 243567; Switzerland | 715188 United Kingdom |
| 352309; Switzerland | 731906 United Kingdom |
| 302326; United Kingdom | 916481 United Kingdom |
| 477118; United Kingdom | 925386 United Kingdom |
| 576423; United Kingdom | 1360965 United Kingdom |
| 593125; United Kingdom | |

SUMMARY OF THE INSTANT INVENTION

The instant invention includes an all-plastic hanger with a swivel hook and all-plastic clips. The hanger and the clips are each usable independently of the other. The hanger includes a body portion and hook means swivelably connected thereto for supporting the body portion. The body portion includes a pair of parallel arms joined together at the ends thereof and a crossbar portion interconnecting the midpoints of the parallel arms.

The arms of the body portion and the hook means are each substantially cylindrical in cross-section along the entire length thereof. The hook means includes an arcuate upper portion and a connecting portion with a cylindrical shaft a cylindrical socket. The end of the shaft includes a peripheral collar projecting radially outwardly therefrom. The socket and enable the body portion and hook means to be swiveled with respect to each other.

The clip is arranged for ready assembly and releasable securement to the arms of the hanger or to any other elongated element having a longitudinal axis. The clip comprises a pair of jaws formed of a first plastic material and resilient spring formed of a second plastic material. The second material has a higher tensile strength than the first material. Each of the jaws is a generally planar member comprising an enlarged first end portion defining a finger grasping opening, an intermediate portion, and a second end portion including a projection extending normally to the plane of the jaw member. The intermediate portions are joined together by a bridge member which includes an arcuate recess for receipt of a portion of the periphery of the body portion arms or other similar element. The bridge member is joined to the jaw members by living hinges. When mounted on the clip, the spring is provided in the form of a generally inverted, U-shaped member having a pair of inwardly flared legs. The spring is arranged to force the jaws together to grasp an article therebetween. The arcuate recess mounts on the arm of the hanger (or similar element) so that the clip can be readily slid therealong and pivoted thereabout.

DESCRIPTION OF A PREFERRED EMBODIMENT

Figure 1:
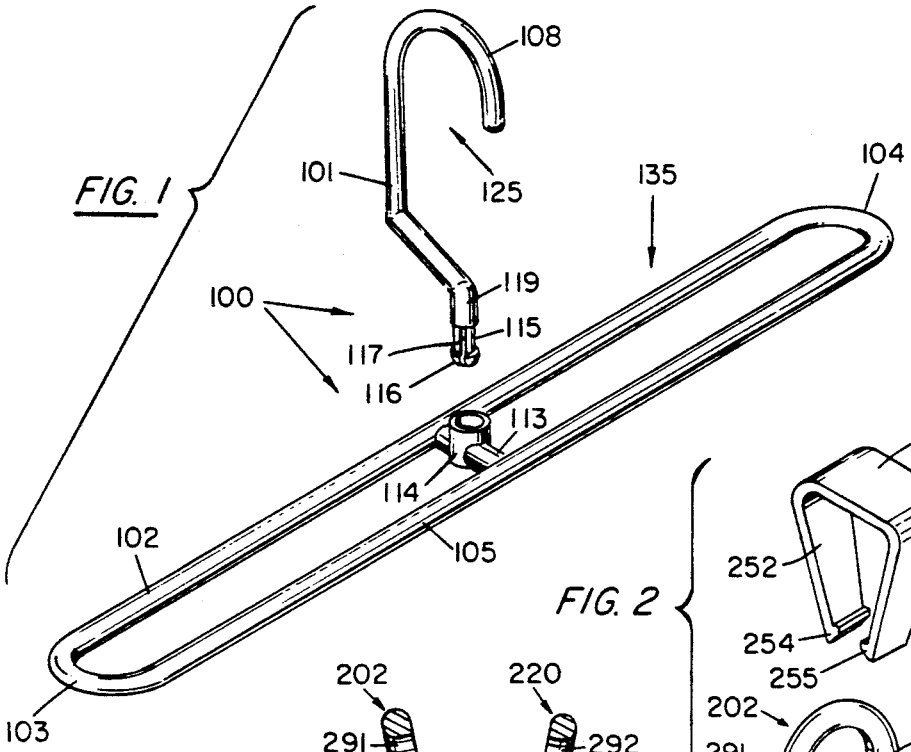
FIG. 1 is an exploded view of one embodiment of the hanger of the instant invention.

It should be understood that in the various Figures, like reference characters refer to like components.

Referring now to FIG. 1, there is a shown an exploded view of a hanger 100 constructed in accordance with the instant invention. The hanger 100 comprises a body portion 135 and a hook portion 125. The hook portion 125 is connected to the body portion 135 for suspending the body portion from a support (not shown). The hook portion 125, as will be described in detail later, is connected to the body portion 135 so that the parts can swivel freely with respect to each other. In accordance with the preferred embodiment, each portion of the entire hanger 100 is substantially cylindrical in cross-section (for example, see FIG. 4).

The body portion 135 comprises a pair of substantially parallel arms 102 and 105. The arms 102 and 105 are connected together at the ends thereof by end portions 103 and 104 which are, preferably, arcuate. Thus, the body portion 135 resembles an elongated loop or oval. In addition, the midpoints of arms 102 and 105 are joined together by a crossbar 113. A socket 114 is included in the midpoint of the crossbar 113. The socket 114 comprises a relatively short hollow cylinder. The hollow axial bore of socket 114 is aligned transverse to the crossbar 113 and normal to the plane of the body portion 135.

The body portion 135 is, typically, molded as an integral unit of a low cost plastic which is strong, lightweight, and durable, such as polypropylene.

As can be seen in FIG. 1, the hook 125 includes an arcuate upper portion 108, an intermediate portion 101 and a is arranged to connect the hook 125 to the body portion 135 to enable the body to be supported by the hook, yet be swiveled freely about the longitudinal axis of the stem 119.

The stem 119 of the hook 125 of the hanger 100 includes a portion 115 thereof which has a smaller diameter than stem 119. Portion 115 takes the form of an annular recess around the periphery of the stem 119. The shaft portion 115 mates with the socket 114 in crossbar 113. The outside diameter of the shaft 115 is just slightly smaller than the inside diameter of the socket 114 so that the shaft 115 can be snap-fit within the socket 114. Typically, the shaft is engaged by squeezing the ends of stem 119, as permitted by the slit 117 which is provided in the end thereof. The peripheral collar 116 (also split by slit 117) passes through socket 114 squeezed and expands when the pressure thereon is released. The annular recess 115 is then retained within socket 114. By squeezing on collar 116, the stem can also be removed from the collar 116.

Like the body portion 135, the hook portion 125 is also formed as an integral unit, preferably, of the same plastic as that of the body portion. The use of a somewhat resilient plastic, such as polypropylene, enables the shaft 119 to be readily inserted and snap-fit within the socket 114, thus facilitating the assembly of the hanger 100. When the shaft 119 is snap-fit within the socket 114, the hook and body can be freely swiveled with respect to each other.

Figure 2:
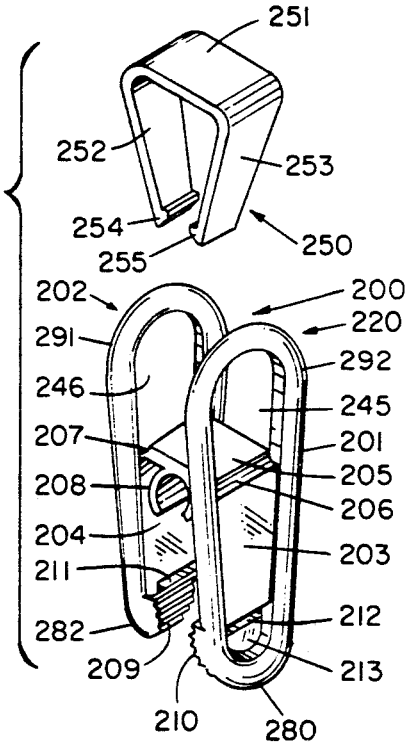
FIG. 2 is an exploded view of one embodiment of the clip of the instant invention.

Referring now to FIG. 2, there is shown an exploded view of the clip 200. As can be seen, the clip 200 comprises a pair of facing, complementary jaws 202 and 220 with an intermediate bridge 205 connecting the jaws to one another. The jaws are connected to bridge 205 by living hinges 206 and 207. A spring 250 is provided to force the jaws together. The spring 250 is mounted over the bridge 205 and adjacent to the outer surface of jaws 202 and 220. Each of the jaws is formed of a plastic material which is low cost, lightweight, durable and resilient. The spring 250 is formed of a plastic material which, preferably, exhibits a higher tensile strength and resilience than the material used to fabricate the jaws 202 and 220. In a preferred embodiment, the jaws 202 are formed of polypropylene, while the spring 250 comprises polycarbonate. Of course, other suitable materials can be utilized if desired.

Figure 4:
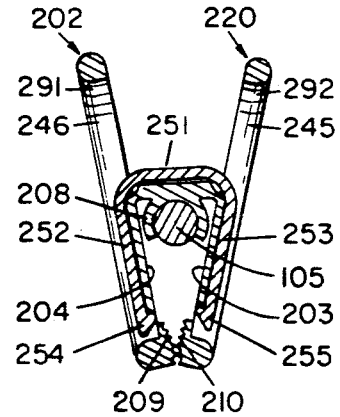
FIG. 4 is a cross-sectional view taken along lines 4—4 of FIG. 3.

Referring concurrently to FIGS. 2 and 4, it is seen that each jaw 202 and 220 is formed as a substantially planar loop. While not specifically limited thereto, each loop includes an enlarged upper end portion 291 or 292, an intermediate portion 203 or 204 and a narrow bottom end portion 209 or 210.

The enlarged upper end portion 291 and 292 of the jaws 202 and 220, respectively, are generally of loop-like construction and include an opening 245 or 246, respectively. The openings 245 and 246 are suitably dimensioned to enable a user's fingers to be comfortably received therein, but not extend therethrough. Thus, the jaws 202 and 220 can be grasped comfortably at the large ends thereof to facilitate the opening of the clip.

The jaws 202 and 220 are arranged to be disposed face-to-face, with the bridge element 205 forming a connection therebetween. The spring 250 surrounds a portion of the opposed jaws and bridge 205 so as to force the bottom ends of the clip together.

The smaller end portions 282 and 208 of the jaws 202 and 220, respectively, are also of generally loop-like construction and include the semi-circular free end projections 209 and 210 projecting inwardly from the inner surface thereof. The opposed free end projections 209 and 210 each include a plurality of ridges on the inner surface thereof. Preferably, the ridges extend across the full width of the projection and are adapted to engage and hold a garment securely therebetween under the bias force provided by the spring 250. The ridges increase frictional engagement between the clip and the garment but could, otherwise, be omitted.

The opposed end portions 209 and 210 form a gripper for the clip which can be opened to receive a garment (or any other item). The gripper is opened by grasping the clip by the upper end portions of the loops 202 and 220 and squeezing those portions toward each other against the bias force of spring 250. Upon release of the upper end portions, the spring 250 forces the jaws back together to effect the holding of an item tightly between the opposed projections 209 and 210 at the lower jaw ends.

The intermediate portion of each jaw includes a relatively planar portion 203 or 204 which is substantially co-planar with the inner surface of the loop. The lower ends of planar portions 203 and 204 are spaced above and slightly inward from the inner surface of the projections 209 and 210. The upper ends of planar portions 203 and 204 are connected to the bridge 205 which extends between the two loop portions. The planar portions 203 and 204 are joined to the opposite ends of the bridge 205 by the respective living hinges 206 and 207. Thus, the loop members can freely pivot around the ends of the bridge 205.

In addition, an arcuate recess 208 which is suitably configured to receive a portion of the periphery of the hanger arm 102 or 105 or any other element having a circular (or cylindrical) surface, is formed at or attached to the undersurface of the bridge 205.

The outside of the planar portions 203 and 204 of each jaw extends downwardly toward the projections 209 and 210 and form an arcuate recess 213 within the lower loop end and the planar surface 203 of the outer surface of projection 210. Thus, a locking slot or recess 213 is located on the outside of the jaw adjacent to the planar surface portion 203. Each locking recess 213 is adapted to receive a respective end of the spring 250 to secure the two jaws and the spring to each other.

The spring 250 (or resilient bias means) has a generally inverted U-shape having a pair of inwardly flaring legs 252 and 253 joined together by a planar mid-portion 251. Each of the legs terminates at its free end in an enlarged semi-circular projection 254 or 255 which is adapted to be received within a respective one of the recesses 213 in the jaws 202 and/or 220.

A slot 211 or 212 is provided adjacent to the recess 213 in each jaw member in order to permit the spring 250 to be selectively removed from the jaw members by insertion of a suitable tool.

In the assembly of the clip 200, the pair of jaws 202 are located opposite to each other on the bridge 205. The inverted U-shaped spring 250 is then slipped about the bridge 205 so that the projections 254 and 255 engage the outer surfaces of the planar portions 203 and 204 of the jaws. By pushing on the mid-portion 251 of the resilient means 250 toward the jaw ends 210, the spring 250 slides toward those ends, with the portions 254 and 255 of the spring sliding along the surfaces 203 or 204 until such portions reach the recesses 213 in the loop. When this occurs, the projections 254 and 255 snap into the recesses 213, thereby locking the spring 250 in place. The bias unit 250 then forces the jaws 209 and 210 into contact with each other. Once the clip components are secured, there is sufficient frictional engagement between the jaws for the clip to operate properly. In addition, the arcuate surface 208 can be readily slid along an arm of the hanger (or the like) when desired, but is resistant to accidental sliding. Moreover, the clip can be pivoted through an arc of 360° about the longitudinal axis of the hanger arm which is journalled within the opening of the clip.

As can be seen in FIG. 4, the angular extent of the arcuate recess 208 is somewhat less than 360° thereby to enable the recess to removably grip the arm 105. The arcuate recess 208 of the clip prevents the clip from falling off of the arm even when the clip is not fully closed.

To remove the clip 200 from the arm 105, pressure is applied against the upper ends of the loops to overcome the force applied by the resilient spring 250. The clip is then retracted by pulling recess 208 away from the hanger arm (or other support).

As will be appreciated from the foregoing, the hanger 100 and the clip 200 of the instant invention are each simple in construction, relatively inexpensive, easily assembled and disassembled, and aesthetically pleasing in appearance.

Figure 3:
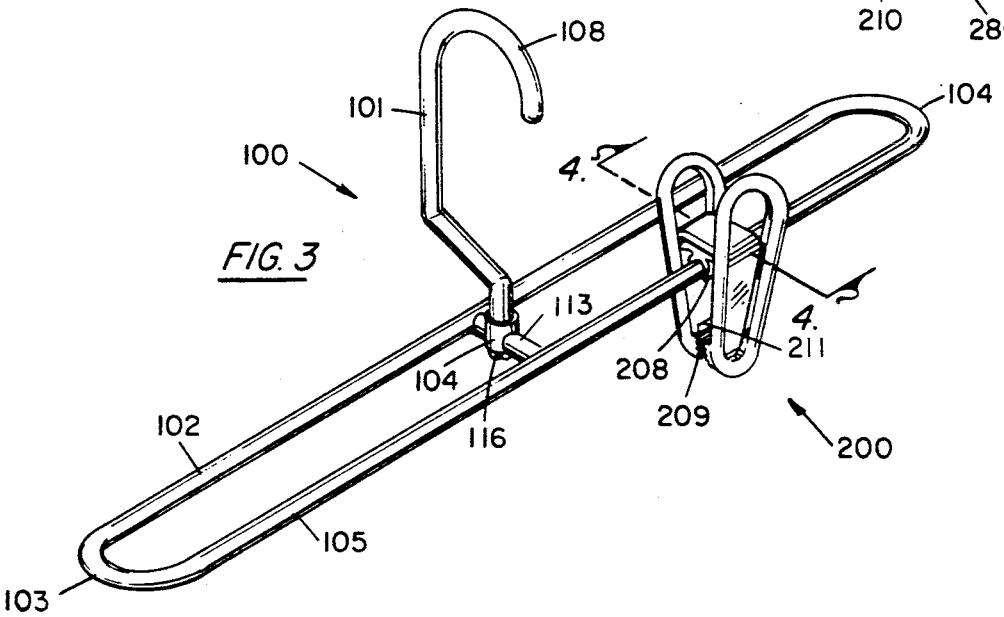
FIG. 3 is a perspective view of the clip of the instant invention mounted on the hanger of the instant invention.

Even though the clip 200 is shown mounted on the hanger 100 in FIG. 3, either the hanger 100 or the clip 200 can be used independently of one another. To that end, the hanger 100 may be used without any clip thereon; may be used with suitably constructed prior art clips; or may be used with the clip 200. The clip 200 may be used with the hanger of this invention; with prior art garment hangers; or with any structural body having an elongated, rod-like configuration. The clip permits longitudinal movement therealong as well as a swivel movement thereabout. Use of the clip on a flexible member having a cylindrical surface portion, e.g., a clothesline, is also contemplated.

Thus, there is shown and described a unique design and concept of a hanger and clip. The particular configuration shown and described herein relates to a preferred embodiment. While this description is directed to a particular embodiment, it is understood that those skilled in the art may conceive modifications and/or variations to the specific embodiments shown and described herein. Any such modifications or variations which fall within the purview of this description are intended to be included therein as well. The description herein is intended to be illustrative only and is not intended to be limitative. Rather, the scope of the invention described herein is limited only by the claims appended hereto.

I claim:

1. A clip comprising,
a pair of jaws,
a bridge member joined to each of said jaws by hinge means, and
resilient bias means,
each of said jaws comprising a generally planar member including a first end portion, an intermediate portion, and a second end portion,
a projection at said second end portion of each of said jaws and extending at an angle to the pane of said jaw,
said bridge member including an arcuate recess therein for selectively receiving a support element therein,
said resilient bias means comprising a generally inverted U-shaped member having a base and a pair of inwardly flared legs,
each of said flared legs of said bias means terminating in a free end,
said base of said bias means overlying said bridge member and said free ends of said resilient bias means being spaced apart and able to be readily secured to said jaws, with each of said legs overlying and engaging a respective one of said jaws adjacent said intermediate portion and said second end portion, for forcing said second end portions of said jaws into engagement with each other.

2. The clip of claim 1 wherein,
each of said jaws is in the form of a planar loop.

3. The clip recited in claim 2 wherein,
said first end of said planar loop is open therethrough.

4. The clip of claim 1 wherein,
said resilient bias means is formed of polycarbonate.

5. The clip recited in claim 1 wherein,
said bridge means is joined to said intermediate portion of each of said jaws.

6. The clip recited in claim 1 wherein,
said arcuate recess is disposed on the underside of said bridge member.

7. The clip recited in claim 1 wherein,
the projections at said second end portions of said jaws extend toward each other.

8. The clip recited in claim 7 wherein,
each of said projections includes a ridged surface.

9. The clip recited in claim 1 wherein,
said intermediate portion of each jaw comprises a planar surface.

10. The clip recited in claim 1 wherein,
said jaws are fabricated of a first plastic material, and
said bias means is fabricated of a second plastic material.

11. The clip recited in claim 10 wherein,
said first plastic material is polypropylene.

12. The clip recited in claim 1 wherein,
said first end of said jaw is larger than said second end.

13. The clip recited in claim 1 wherein,
said second end portions of each jaw includes a depression therein, and
each of said free ends of said bias means an enlarged section which engages the depression in the respective second end portion of said jaw.

14. The clip recited in claim 13 including, slot means in at least one of said depressions whereby said enlarged section of said bias means can be selectively disengaged from said depression.

15. The clip recited in claim 1 wherein, said arcuate recess is adapted to provide a friction fit with said support element.

* * * * *